US006471062B2

(12) United States Patent
Usui et al.

(10) Patent No.: US 6,471,062 B2
(45) Date of Patent: Oct. 29, 2002

(54) PACKAGING BOX AND METHOD PACKAGING

(75) Inventors: Takayuki Usui, Shizuoka-ken (JP); Takehiro Sone, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/976,148

(22) Filed: Oct. 15, 2001

(65) Prior Publication Data

US 2002/0033351 A1 Mar. 21, 2002

Related U.S. Application Data

(63) Continuation of application No. 09/469,163, filed on Dec. 21, 1999, now Pat. No. 6,332,537.

(30) Foreign Application Priority Data

Dec. 21, 1998 (JP) ..... 10-362719
Aug. 18, 1999 (JP) ..... 11-231546

(51) Int. Cl.[7] ..... B65D 81/05; B65D 5/32

(52) U.S. Cl. ..... 206/521; 229/103.3; 229/125.35; 229/169; 229/940

(58) Field of Search ..... 206/449, 451, 206/455, 499, 526, 555, 521; 229/103.3, 125.35, 125.37, 125.39, 169, 939, 940

(56) References Cited

U.S. PATENT DOCUMENTS

| | | | | | |
|---|---|---|---|---|---|
| 385,451 | A | * | 7/1888 | Ellis | 206/521 |
| 2,549,682 | A | * | 4/1951 | Grossniklaus | 229/169 |
| 2,742,145 | A | * | 4/1956 | Blackburn et al. | 206/521 |
| 3,227,354 | A | * | 1/1966 | Gunyou | 206/521 |
| 3,598,233 | A | * | 8/1971 | Jasinover | 206/521 |
| 3,622,063 | A | * | 11/1971 | McVeigh | 229/125.35 |
| 4,171,742 | A | * | 10/1979 | Kohayakawa et al. | 206/449 |
| 4,314,638 | A | * | 2/1982 | Gordon et al. | 206/594 |
| 5,871,102 | A | * | 2/1999 | Lambert | 206/449 |
| 6,332,537 | B1 | * | 12/2001 | Usui et al. | 206/521 |

FOREIGN PATENT DOCUMENTS

| | | |
|---|---|---|
| JP | 57-38150 | 8/1982 |
| JP | 10-16946 | 1/1998 |

* cited by examiner

*Primary Examiner*—Bryon P. Gehman
(74) *Attorney, Agent, or Firm*—Sughrue Mion, PLLC

(57) ABSTRACT

A packaging box is formed by a bottom surface member disposed at the side of a bottom surface of goods to be packaged, and a top surface member disposed at the side of a top surface of the goods to be packaged. The bottom surface member includes a base panel, side panels formed extending integrally from the base panel and further shaped to correspond to side surfaces of the goods to be packaged. An attachment panel extends integrally from the end of each side panel. The top surface member and base panel typically include corrugations. The corrugations in each item are preferably oriented generally transverse to one another, thereby increasing the strength of the structure without requiring additional material.

16 Claims, 13 Drawing Sheets

PACKAGING BOX AND METHOD PACKAGING

This is a continuation of application Ser. No. 09/469,163, filed Dec. 21, 1999, now U.S. Pat. No. 6,332,537.

BACKGROUND OF THE INVENTION

1. Field of the Invention

The present invention relates to a packaging box for packaging goods, and a packaging method using the packaging box, which packaging box and method are used, for example, when intermediately packaged photosensitive printing plates are further packaged (externally packaged).

2. Description of the Related Art

FIG. 10 shows a conventional packaging box 110 as an example. FIG. 11 shows the packaging box 110 before it has been folded (see Japanese Patent Application Publication (JP-B) No. 57-38,150).

As shown in FIG. 11, in the packaging box 110, bottom-surface lamination panels 116 and upper-surface lamination panels 118 are formed adjacently to respective two short sides of a bottom surface panel 112 and an upper surface panel 114. A plurality of bend lines 120 are formed in each of the bottom-surface lamination panel 116 and the upper-surface lamination panel 118. By folding these lamination panels along the bend lines 120, as shown in FIG. 10, four-sided spiral-wound portions 122 and 124 are formed. As a result, goods contained in the packaging box 110 are protected. For example, if a great impact acts on the box from outside, the impact transmitted internally is reduced thereby helping to prevent damage to the goods.

As described above, in the conventional packaging box 110, a process in which the bottom-surface lamination panel 116 and the upper-surface lamination panel 118 are folded along the plurality of bend lines 120 was required. Further, as the size of goods to be packaged increases, great force becomes necessary for the folding operation. Therefore, folding at correct positions substantially only by a manual operation was very difficult. For this reason, there were cases in which a large-size folding apparatus was required, but it resulted in greater manufacturing costs.

FIG. 12 shows a packaging box 140 different from the packaging box shown in FIG. 10. FIG. 13 shows the packaging box 140 before it has been folded (see Japanese Patent Application Laid-Open (JP-A) No. 10-16,946).

As shown in FIG. 13, in the packaging box 140, side surface panels 144 are respectively extended from the longer sides of a bottom surface panel 142 and cover surface panels 146 extend from the side surface panels 144. Further, a side surface panel 148 and face panels 150 sequentially extend from each of the shorter sides of the bottom surface panel 142. When the packaging box 140 is assembled, as shown in FIG. 12, an upper surface of the box is structured so as to open like a double door and a three-sided tubular body 152 is formed along each side of the box by the side surface panel 148 and the face panels 150.

However, as can be seen from the unfolded configuration shown in FIG. 13, in the packaging box 140, a length of the side surface panel 144 and the cover surface panel 146 extending from the bottom surface panel 142 and a length of the side surface panel 148 and the face panels 150 extending from the bottom surface panel 142 are both long. For this reason, a great quantity of corrugated fiberboard becomes necessary in forming such a packaging box 140. Particularly, as the size of goods to be packaged become larger, the quantity of required corrugated fiberboard increases, thereby resulting in an increase of manufacturing costs.

SUMMARY OF THE INVENTION

The present invention provides a packaging box which can be manufactured at lower cost and by which goods to be packaged can be easily packaged, and further provides a method for packaging goods using the packaging box.

In accordance with a first aspect of the present invention, there is provided a packaging box for receiving and packaging goods. The goods include a top surface and a bottom surface, and a number of side surfaces. The packaging box includes a bottom surface member having a base panel formed substantially in the same shape as the bottom surface of the goods to be packaged. The packaging box further includes a plurality of side panels corresponding in number to the number of side surfaces of the goods. Each side panels extends integrally from the base panel and is substantially the same shape as its respective corresponding side surface of the goods. The box further includes a top surface member formed to have dimensions substantially equal to dimensions as a top surface of the goods.

Accordingly, few or no useless portions are formed in the material composing the packaging box (for example, a sheet material such as corrugated fiberboard or cardboard), the packaging box is foldable, and initially it is provided in a flattened or unfolded configuration. After the goods are packaged in the box, there is substantially no overlap of any of the base panel, the side panels, and the top surface member with one another. Namely, the packaging box can be formed using a reduced amount of material and thus costs are reduced. Moreover, the bottom surface, side surfaces, and top surface of the goods to be packaged are covered by the base panel, side panels, and top surface member of the packaging box. Thus, the goods are protected from bending or deformation.

In packaging, the goods are placed on the base panel of the packaging box when it is unfolded, in such a manner that the bottom surface of the goods substantially coincides with the base panel of the packaging box. Then, the side panels are each folded along a boundary between the base panel and the side panels so as to be substantially made parallel to the side surfaces of the goods. Further, the top surface member is disposed so as to substantially coincide with the top surface of the goods, and the top surface member is fixed in place over the goods. As described above, the number of folds is fewer as compared with a conventional packaging box, and packaging is facilitated. Further, it is not necessary to use a folding device or the like, and therefore, costs are reduced.

In accordance with a second aspect of the present invention, the packaging box further includes an attachment flap integrally extending from each side panel. When the packaging box receives goods therein, each side panel is folded to extend substantially parallel to a corresponding side surface of the goods. The attachment flaps are folded to extend substantially parallel to a top surface of the goods, without the attachment flaps overlapping one another. This permits the top plate member to be fixed to the attachment flaps, thereby connecting the top plate member to the bottom plate member. The lack of overlap between attachment flaps, reduces the amount of material required, and therefore, costs as well.

In accordance with a third aspect of the present invention, when the attachment flaps are folded substantially parallel to the top surface of the goods, the attachment flaps define an opening located substantially centrally above the goods. The opening permits small attachment flaps, further reducing material requirements, and thus costs.

In accordance with a fourth aspect of the present invention, the bottom and top surface members are each formed from a sheet of material. Each sheet includes a plurality of substantially corrugations formed therein. When the packaging box receives goods, the top surface member is placed over the goods with its corrugations oriented substantially transverse to the corrugations in the bottom surface member. Directionality in the strength of the packaging box is therefore reduced and the rigidity of the packaging box is increased. Thus, the packaging box with goods packaged therein is better able to resist deformation and retain a fixed shape. For example, when the packaging box is lifted up by putting hands on the bottom plate and holding the box in one's arms, no consideration of a direction to which hands are placed is required and handling of the packaging box becomes easier.

In accordance with a fifth aspect of the present invention, a reinforcing plate is attached to the bottom panel.

Since the reinforcing plate is attached to the bottom panel, the bottom panel and the reinforcing plate are integrated with each other to improve the strength thereof, and the strength of the entire packaging box. As a result, deflection or deformation of the packaging box is better prevented. Accordingly, even when the goods to be packaged are heavy or have a large bottom surface area (in this case, the area of the bottom panel also becomes large, and therefore, the bottom panel itself is more apt to deflect), the bottom panel integrated with the reinforcing plate better resists deflection or deformation.

Further, the reinforcing plate is attached to the bottom panel, and therefore, there is reduced possibility of the reinforcing plate being inadvertently displaced or separated from the bottom panel.

In accordance with a sixth aspect of the present invention, each side panel extends a distance from the base panel substantially equal to a height dimension of the goods, plus a thickness dimension of the top surface member.

Moreover, the attachment flaps and the side panels are folded after the top plate member is disposed in surface contact with the top surface of the goods. Therefore, the attachment flaps can be brought into surface contact with the upper surface of the top plate member. As a result, the side panels surround the top plate member, and the top plate member is positioned in such a manner that the upper and lower surfaces of the top surface member respectively make surface contact with the attachment flaps and the top surface of the goods. Accordingly, fixing the top surface member to the bottom surface member is facilitated.

Further, when the top surface member is fixed to the bottom surface member using adhesive tape or the like, the adhesive tape may be applied along the ends of the attachment flaps (a position near the center of the top surface of the goods to be packaged). For this reason, in cooperation with the above-described third aspect, the amount of adhesive tape required for fixing the top surface member to the bottom surface member decreases. Further, the adhesive tape can be applied in a planar manner (it is not necessary that the adhesive tape be applied over large corner portions), and therefore, applying the adhesive tape is facilitated.

Even when the top surface member is fixed to the bottom surface member using adhesives such as normal paste, bond, and hot melt adhesive instead of adhesive tape, it suffices that the adhesives be applied along ends of the attachment flaps in a linear or dotted manner. Therefore, the amount of adhesives required is reduced. Additionally, the top surface member may be fixed to the bottom surface member using adhesive tape and other adhesives together, thereby resulting in greater adherence.

In accordance with a seventh aspect of the present invention, a method for packaging goods is provided. The method includes placing the goods on a foldable box (on an interior bottom surface of the box). Then a top surface member of the box is placed over the goods, opposite the bottom surface member. Thereafter, the box is folded, wherein the box includes side panels with an attachment flap extending from each side panel. The side panels are folded to extend toward the top surface member, and the attachment flaps fold to extend substantially parallel to the top surface member. Then, the attachment flaps are fixed to the top surface member.

Typically, the top and bottom surface members will be stronger in one direction. The method further includes orienting the top surface member such that it is placed over the goods with the direction that the top surface member is stronger in, oriented substantially transverse to the direction that the bottom surface member is stronger in. Directionality in the strength of the resulting packaging is thus reduced and rigidity of the package increased.

DESCRIPTION OF THE PREFERRED EMBODIMENTS

Figure 1:
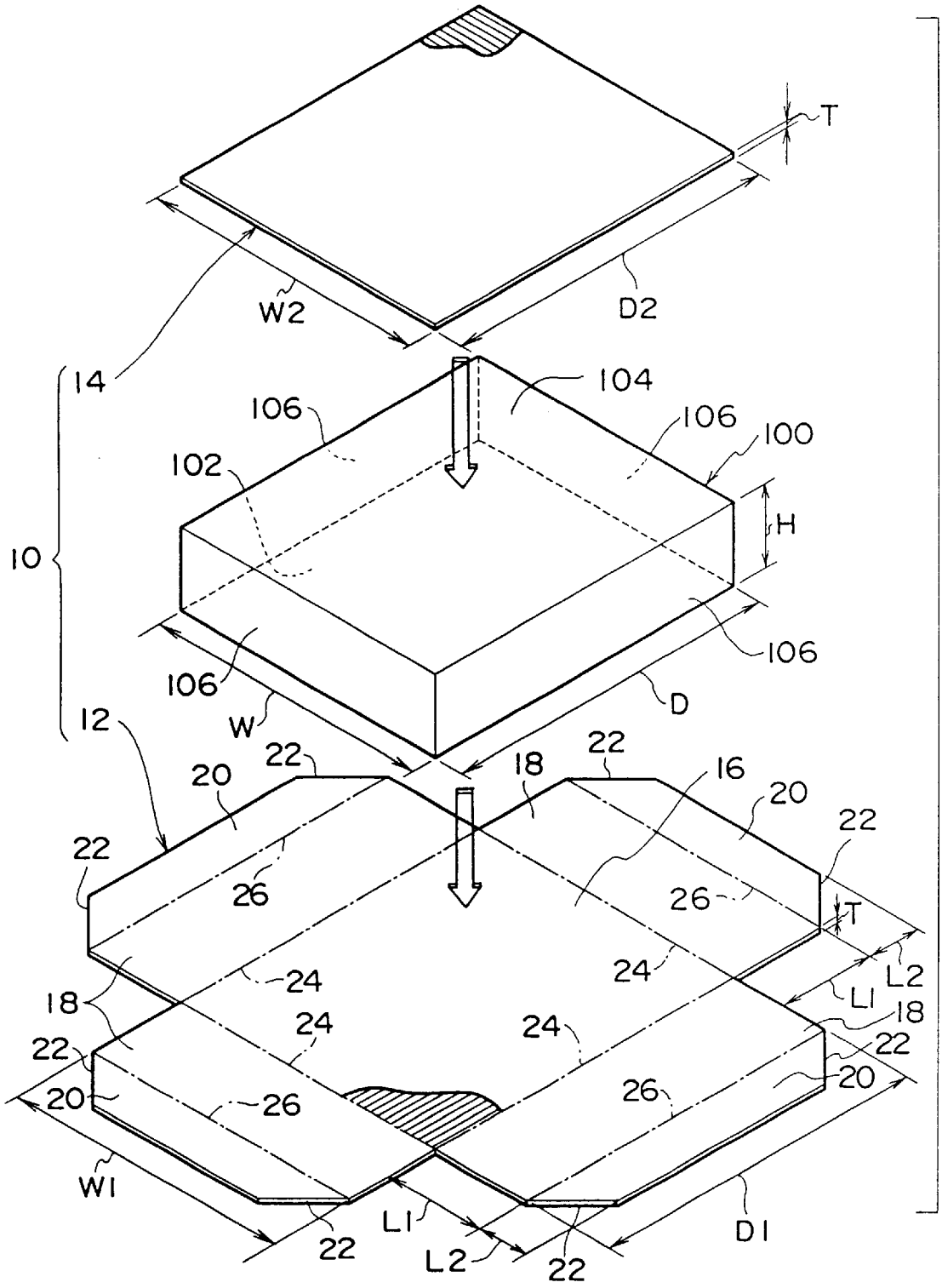
FIG. 1 illustrates a perspective, partial cut-away view of an unfolded packaging box according to a preferred embodiment of the present invention, showing goods being packaged in the box.
Figure 2:
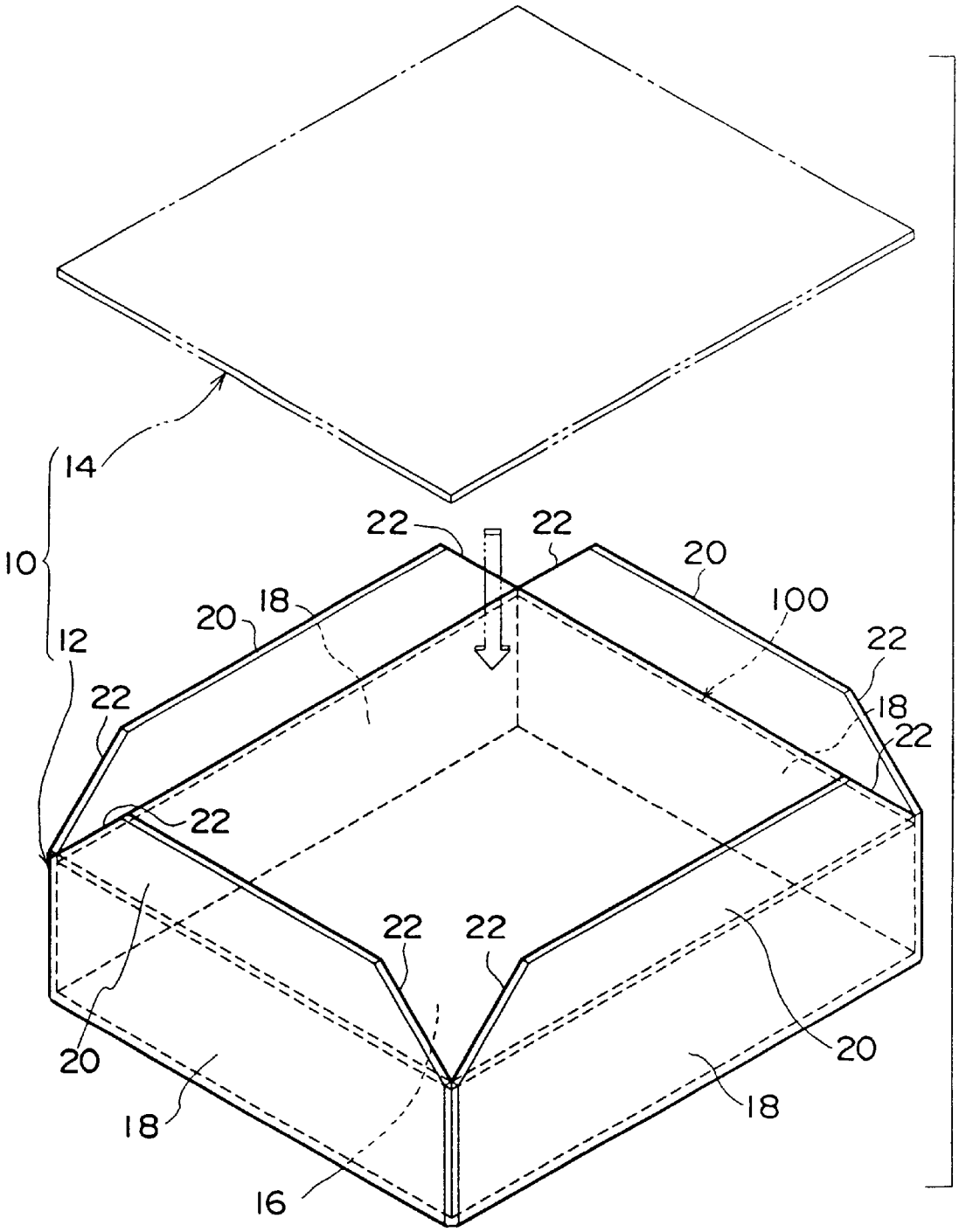
FIG. 2 illustrates a perspective view of the box of FIG. 1, with the goods placed in the box.
Figure 3:
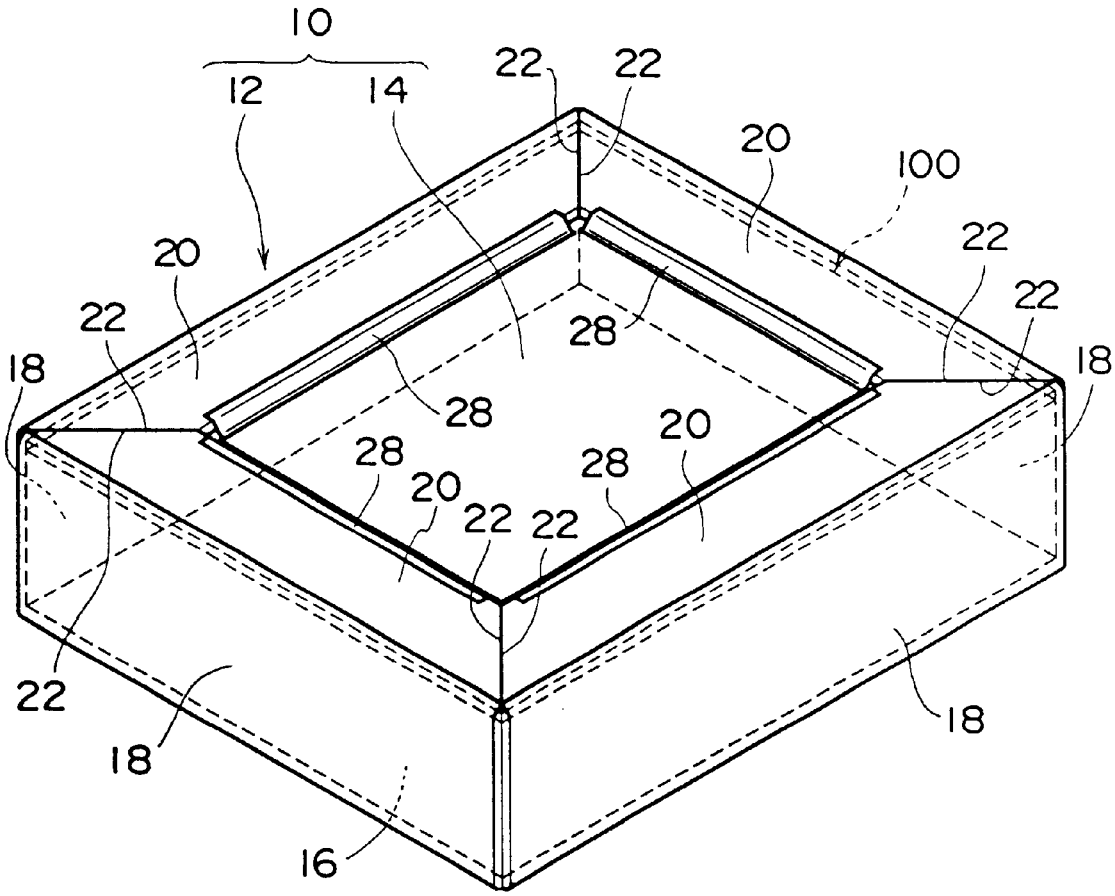
FIG. 3 illustrates a perspective view of the box of FIG. 1, with flaps of the box fixed in place over the goods.

FIG. 1 illustrates a preferred embodiment of a packaging box 10 in accordance with the present invention. The box 10 is foldable and is illustrated initially in an unfolded configuration. FIG. 1 shows goods being packaged in the box 10, such as a stack of photosensitive printing plates (PS plates) 100, for example. FIG. 2 illustrates the box 10 after the stack of photosensitive printing plates 100 have been packaged in (the lower portion of) the box. FIG. 3 shows the box 10 after attachment flaps 20 of the box have been folded and fixed over the stack of photosensitive printing plates 100.

The stack 100 is composed of a plurality of photosensitive printing plates and protective sheets of interposing paper alternately superposed. The entire stack 100 is wrapped by a wrapping material and formed substantially in shape to a right rectangular parallelepiped having a width dimension of W, a depth dimension of D, and a height dimension of H. The wrapping material shades the photosensitive printing plates and prevents exposure to moisture.

In addition, protective paper composed of cardboard, kraft paper, corrugated fiberboard, or a combination thereof may be disposed on one of the upper or lower sides of the stack 100, or both. An adhesive tape may be employed to fix the protective paper in place. After the protective paper is fixed in place, the wrapping material encloses the assembly, thereby forming the stack 100. The protective paper as described above protects the stack (particularly, the photosensitive printing plates) from deformation or damage of the photosensitive printing plates due to impacts. For greater protection, the protective paper is preferably disposed at each of the upper and lower sides of the stack. The adhesive tape used for fixing the protective paper to the stack is not particularly limited in the configuration in which it is applied. For example, with the protective paper fixed by adhesive tape at two places on each of the longer sides of the stack, a constant fixing strength can be maintained even with a small amount of adhesive tape.

The packaging box 10 includes a bottom surface member 12 which constitutes a lower portion of the box. When packaging the stack 100 in the box 10, the base 102 of the stack 100 is placed centrally on the bottom surface member 12. The box 10 includes a top plate member 14, which is placed over the top 104 of the stack 100. When the stack 100 is packaged in the box (see FIG. 3), the assembly as a whole corresponds generally in shape to a right rectangular parallelepiped. Further, the bottom surface member 12 and the top plate member 14 are each formed from corrugated fiberboard having a thickness T.

The bottom surface member 12 includes a base panel 16 having substantially the same shape as the base 102 of the stack 100. As illustrated, the stack base 102 substantially corresponds in shape to a rectangle, having length D and width W. The base panel 16 of the box 10, corresponds substantially in shape to a rectangle, having a length D1 and width W, substantially equal to the length D and width W, respectively of the stack base 102.

The box 10 includes side panels 18 extending integrally from each side of the base panel 16. The side panels 18 respectively correspond to side surfaces 106 of the stack 100. The shape of each side panel 18 is substantially the same in size and shape to that of its corresponding side surface 106 of the stack 100. As illustrated, each side panel 18 extends a distance L1 from the base panel 16. The distance L1 is measured from the inner surface of the base panel 16 when the box is assembled as shown in FIG. 3. As shown in FIG. 2, the distance L1 substantially equals the height H of the stack 100, plus the thickness T of the top surface member 14.

An attachment flap 20 extends integrally from the end of each of the side panels 18. Each attachment flap 20 extends from its respective side plate 18, when the box 10 is folded or assembled as in FIG. 3, a predetermined distance L2 so that opposite respective extended ends of attachment flaps 20 do not contact or overlap each other.

The distal corner of each attachment flap 20 is beveled to form a triangular cut portion 22. When the box 10 is folded or assembled as in FIG. 3, the attachment flaps are folded substantially parallel to the top 104 of the stack 100. Due to the triangular cut portions 22, the attachment flaps 20 do not overlap one another when folded in this way. As illustrated, the attachment flaps fold along bend lines 26.

The beveled angle between the beveled portion and the bend line 26 in each attachment flap 20 is not limited to a particular angle, so long as the attachment flaps 20 do not overlap one another. Preferably, though, the angle is substantially equal to 45 degrees. As a result, adjacent cut portions 22 contact one another in a substantially linear manner when the box is folded or assembled as shown in FIG. 3. This configuration increases the strength of the box 10 and prevent deformation thereof.

As illustrated in FIG. 1, the box 10 folds substantially along bend lines 24 and 26. Bend line 24 defines the boundary between the base panel 16 and the side panels 18. Bend line 26 defines the boundary between each side panels 18 and its respective flap 20. The bend lines 24 and 26 are preformed by, for example, creasing (pre-bending), perforating, or half cutting. Among these, creasing is preferably used from the viewpoint of maintaining the strength of the bottom surface member 12 and facilitation of folding. The bend lines 24 and 26 facilitate correct folding or assembly of the box 10.

The top surface member 14 is formed substantially in the same size shape as that of the top surface 104 of the stack 100. That is, the length D2 of the longer side of the top surface member 14 is substantially equal to the length dimension D of the stack top 104. Further, the length W2 of the shorter side of the top surface member 14 is substantially equal to the width dimension W of the stack top 104.

When the packaging box 10 is folded or assembled (see FIG. 3), the top surface member 14 is oriented so that the corrugations in the sheet of corrugated fiberboard forming the top surface member 14 extend in predetermined direction. Namely, a direction substantially transverse or perpendicular to the direction that the corrugations 27 in the sheet of corrugated fiberboard of the bottom surface member 16 extends. The arrangement increases the strength of the packaging box 10 because corrugated fiberboard is generally stronger in one direction. For example, when the external packaging box 10 is lifted up with the bottom plate 16 being held by worker's hands, it becomes unnecessary to consider a direction in which the box is held.

Next, a method for packaging the stack 100 using the external packaging box 10 according to a preferred embodiment will be described.

In order that the stack 100 be packaged using the external packaging box 10, first, as shown in FIG. 1, the bottom surface member 12 is provided in a planar manner (i.e., unfolded), and the stack 100 is placed on the bottom surface member 12 so that the base 102 of the stack 100 coincides with the bottom plate 16.

As shown in FIGS. 1 and 2, the top surface member 14 is placed on the top 104 of the stack 100. Further, the bottom surface member 12 is folded along the bend lines 24 so that the side panels 18 are made substantially parallel to the side surfaces 106 of the stack 100. In this arrangement, the side panels 18 are preferably brought into surface contact with the side surfaces 106 of the stack 100. However, it is not absolutely necessary that the side panels 18 be brought into surface contact with the side surfaces 106. The side panels 18 and side surfaces 106 may be disposed to substantially face in parallel with a small clearance being formed therebetween.

The length L1 that each side panel 18 extends from the bottom surface member plate 16 (see FIG. 1) is substantially equal to the height H of the stack 100 plus the thickness T of the top surface member 14. Therefore, an end portion of each side panel 18 contacts the top surface member 14 or faces the top surface member 14 with a small clearance formed therebetween. Should a force act to dislodge the top surface member 14 from a position centrally over the top 104 of the stack 100, the side panels 18 retain the top surface member centrally over the stack top 104. As a result, the top surface member 14 retained in a position coinciding with the stack top 104 without any significant offset being introduced.

Alternatively, prior to the top surface member 14 being placed on the top 104 of the stack 100, the bottom surface member 12 is bent or folded along the bend lines 24 so that the side panels 18 are made substantially parallel to the side surfaces 106 of the stack 100. Thereafter, the top surface member 14 is placed on the top 104 of the stack 100. In this case, the end of each of the side panels 18 extends upward, slightly past the stack top 104. Therefore, with the top surface member 14 being disposed between the extended portion of the side panels 18, the top surface member 14 can be readily placed to coincide with the top 104 of the stack 100.

Subsequently, the bottom plate member 12 is bent or folded along the bend lines 26. This positions the attachment flaps 20 on the exterior of the top surface member 14 substantially parallel to the top surface member 14. As shown in FIG. 3, adhesive tape 28 is applied to the attachment flaps 20 and the top surface member 14. Specifically, the tape 28 is applied along the interface line between the attachment flaps 20 and the top surface member 14 to fix these items together. As a result, the external packaging box 10 is assembled and the stack 100 is packaged within the box 10. Therefore, transportation of goods can be carried out with the external packaging box 10.

Further, in this arrangement, the outer surface of the stack 100 contacts the inner surface of the external packaging box 10 or faces the inner surface thereof, with a predetermined small clearance being formed therebetween. Accordingly, the stack 100 is maintained at a substantially fixed position with respect to the external packaging box 10. Further, even when the external packaging box 10 is struck by a foreign object, photosensitive printing plates which form the stack 100 are protected from damage or deformation by the box 10.

Figure 10:
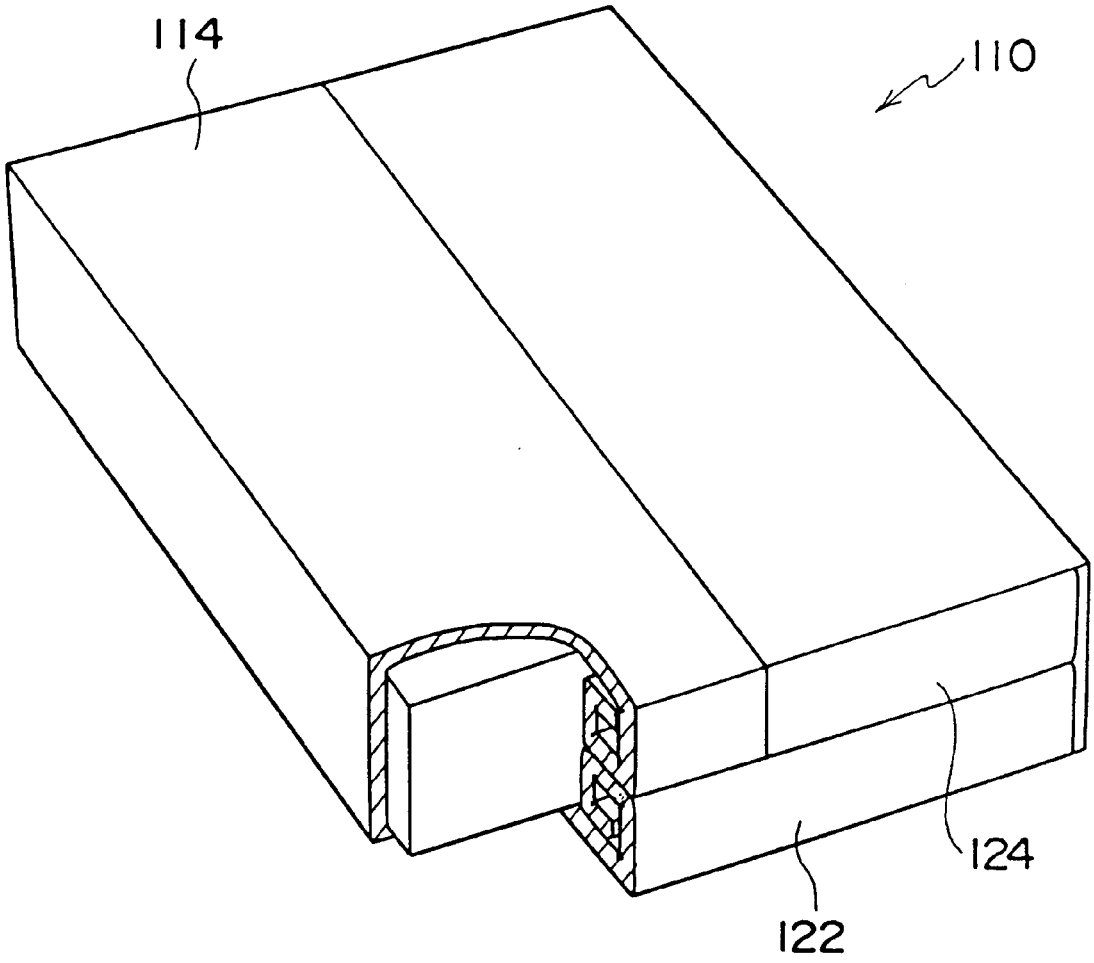
PRIOR ART FIG. 10
FIG. 10 illustrates a perspective, partial cut-away view of a conventional packaging box.
Figure 11:
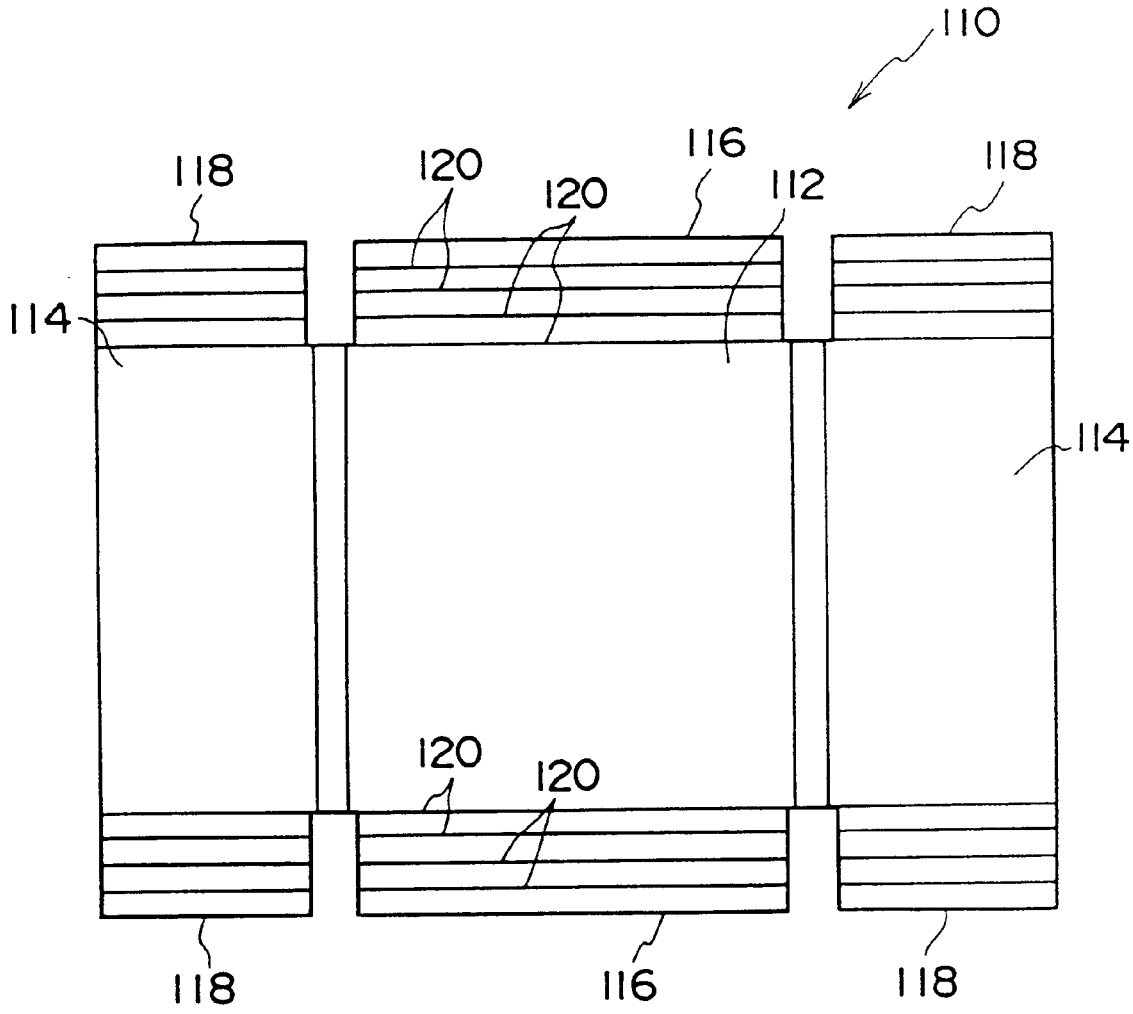
PRIOR ART FIG. 11
FIG. 11 illustrates a plan view of the box of FIG. 10, in an unfolded configuration, without any goods.
Figure 12:
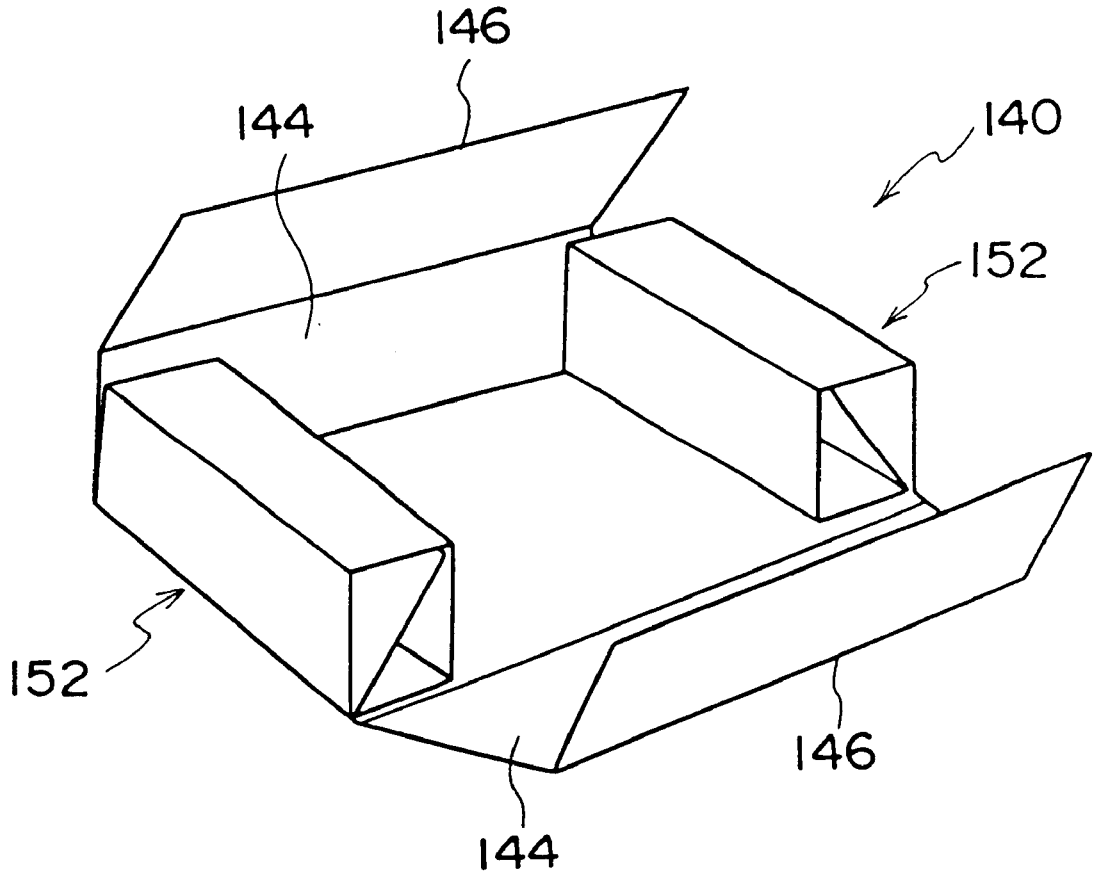
PRIOR ART FIG. 12
FIG. 12 illustrates a perspective view of another conventional packaging box, with the box partially unfolded.
Figure 13:
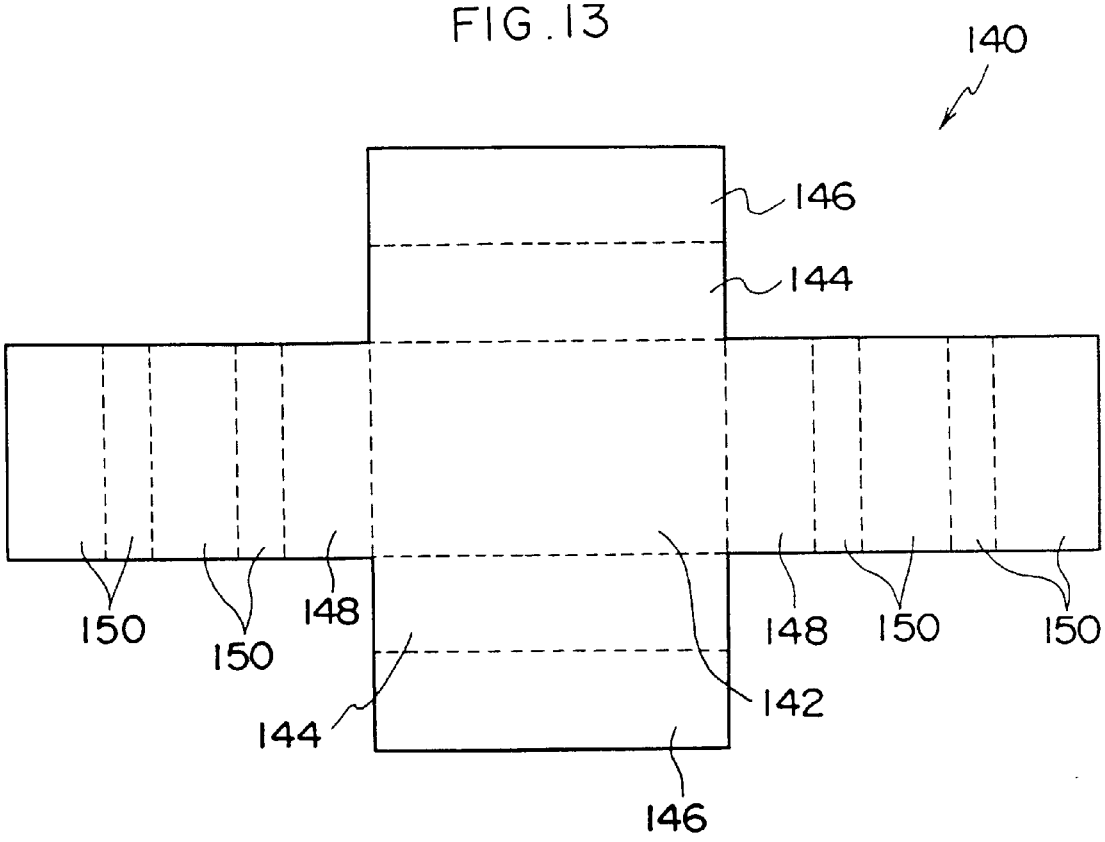
PRIOR ART FIG. 13
FIG. 13 illustrates a plan view of the box of FIG. 12, completely unfolded.

In the previously described embodiment, folding is only required along the bend lines 24 and 26. As compared with the conventional packaging box 110 shown in FIGS. 10 and 11 or the conventional packaging box 140 shown in FIGS. 12 and 13, the amount of folding is relatively minimal. Therefore, the external packaging box 10 can be easily assembled. Further, it is not necessary to use a device for folding, thereby resulting in reduction in cost.

Moreover, in the assembled external packaging box 10 (see FIG. 3), only the attachment flaps 20 overlap the top surface member 14. Therefore, it reduces the risk of incorrect folding or of the box 10 being formed into a tubular structure. In addition, a space is formed between the ends of the attachment flaps 20 (i.e., at the center of the stack top 104), when the box 10 is folded. Namely, an overall length of each side panel 18 and its respective attachment flaps 20 extending from the base panel member 16 (L1+L2) is shorter as compared with the conventional packaging boxes 110 and 140 shown in FIGS. 10 to 13. Therefore, the stack 100 can be packaged by a reduced amount of corrugated fiberboard and the external packaging box 10 can be manufactured at lower cost.

Figure 4:
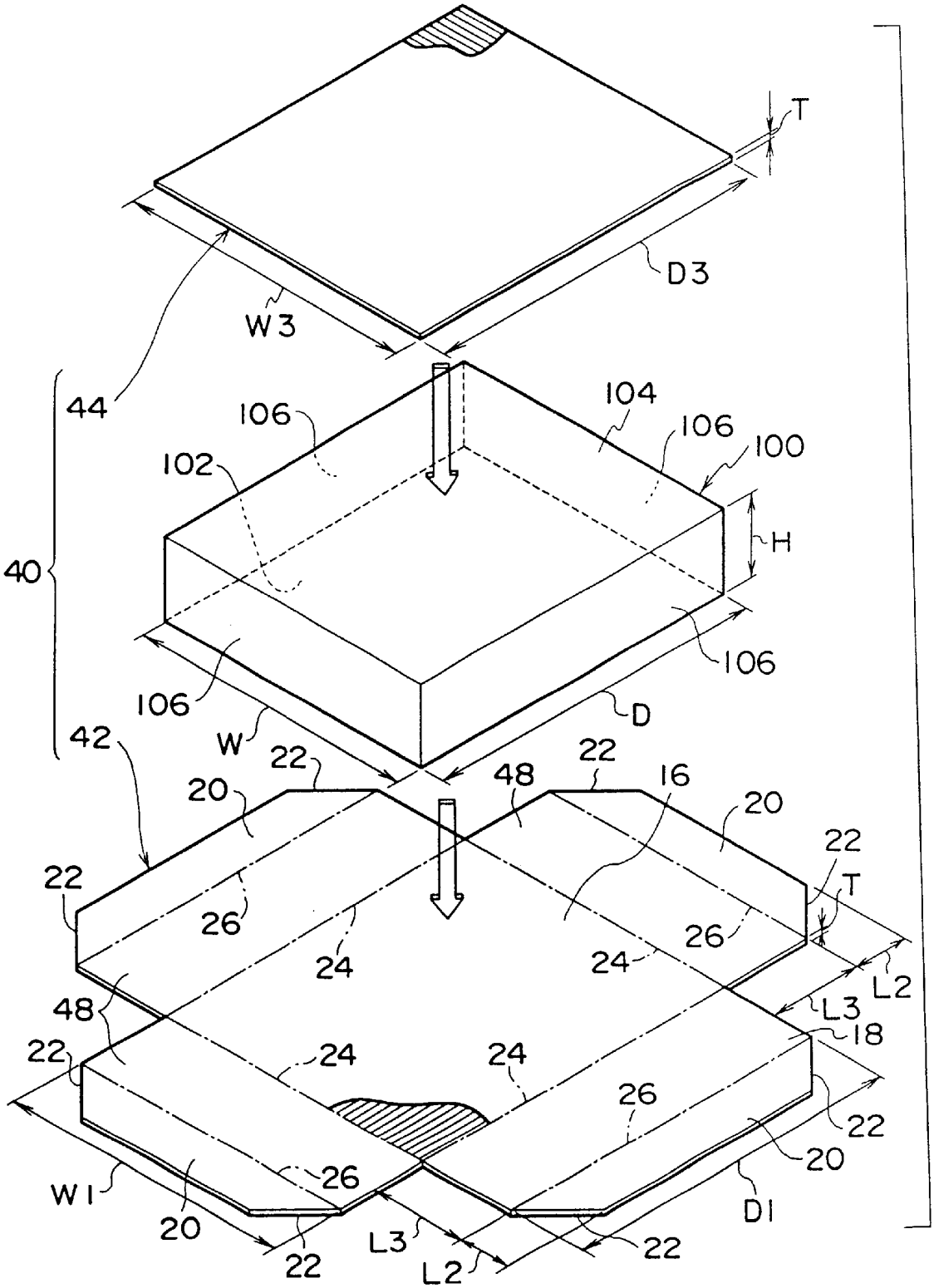
FIG. 4 illustrates a perspective, partial cut-away view of an unfolded packaging box according to another preferred embodiment of the present invention, showing goods being packaged in the box.
Figure 5:
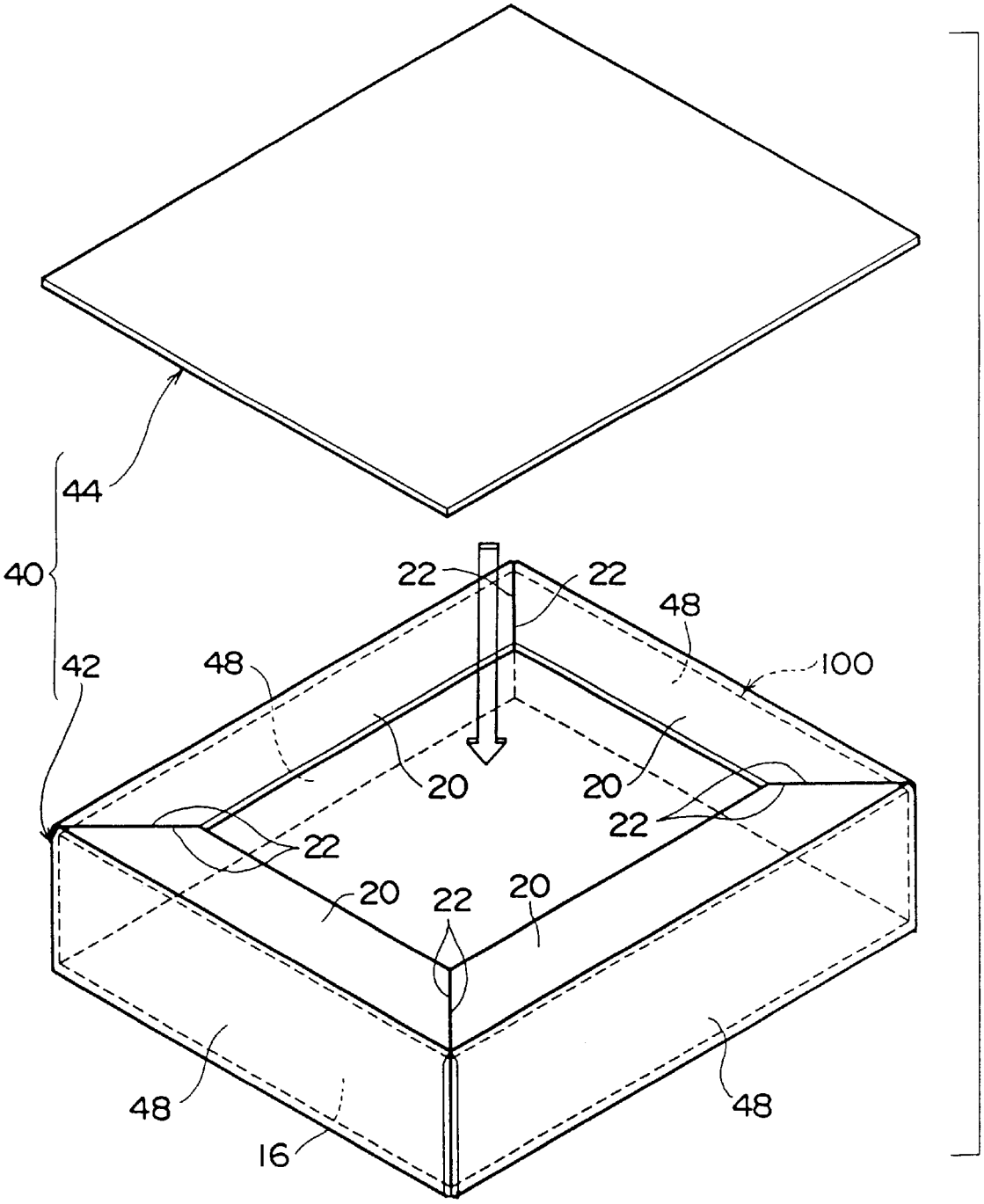
FIG. 5 illustrates a perspective view of the box of FIG. 4, with the goods placed in the box.
Figure 6:
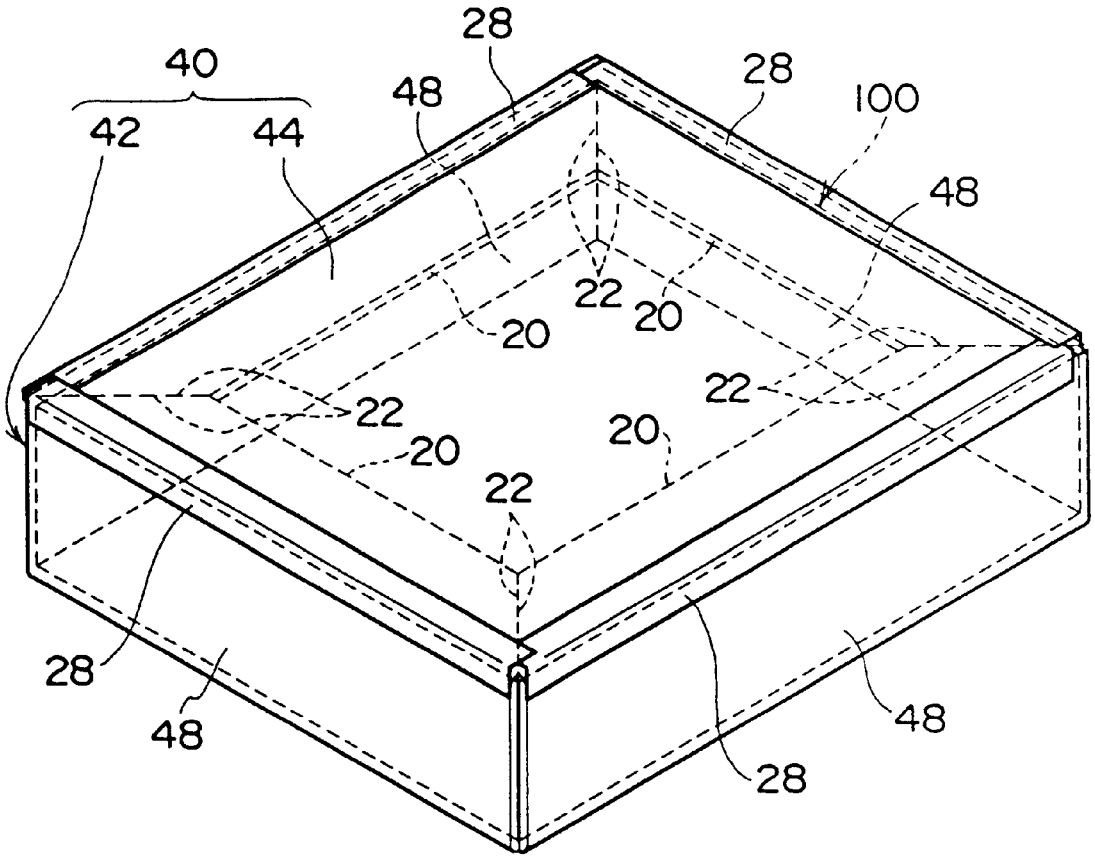
FIG. 6 illustrates a perspective view of the box of FIG. 4, with a top section member of the box fixed in place over the goods.

FIG. 4 shows an external packaging box 40 according to another preferred embodiment of the present invention. FIG. 5 shows a process in which the stack 100 is packaged using the external packaging box 40. FIG. 6 shows the box 40 after it has been assembled.

The external packaging box 40 is different from the external packaging box 10 of the previously described embodiment in the shapes/sizes of the side panels 48 and the top surface member 44. Note that substantially identical items as those of the previously described embodiment will be denoted by the same reference numerals and a description thereof will be omitted.

In the external packaging box 40, the length L3 of the side panels 48 extending from the base panel 16 is substantially equal to the height H of the stack 100. Further, the top surface member 44 is sized to have a width W3 substantially equal to the width W of the stack top 104, plus twice the thickness of the top surface member 44. The top surface member is additionally sized to have a length D3 substantially equal to the length D of the stack top 104, plus twice the thickness of the top surface member 44.

When the stack 100 is packaged using the external packaging box 40, first, in the same way as in the first embodiment, the bottom surface member 42 is provided in a planar manner (i.e., unfolded) and the stack 100 is placed on the base panel 16 of the bottom surface member 42 so that the bottom 104 of the stack 100 substantially coincides with the base panel 16.

Next, as shown in FIG. 5, the bottom surface member 42 is bent or folded along the bend lines 24 and the side panels 48 are made substantially parallel to the side surfaces 106 of the stack 100. The bottom surface member 42 is further bent or folded along the bend lines 26 so that the attachment flaps 20 are made substantially parallel to the top 104 of the stack 100.

Then, the top surface member 44 is placed over the top surfaces of the attachment flaps 20, such that the four sides of the top plate member 44 are substantially coincident with outer surfaces of the side panels 48. Finally, as shown in FIG. 6, adhesive tape 28 is used to attach the side panels 48 and the top surface member 44 along the periphery of the top surface member 44 so that the side panels 48 and the top surface member 44 are fixed together. As a result, the external packaging box 40 is assembled with the stack 100 packaged therein. Accordingly, the external packaging box 40 can be held and transported. Further, as in the previous embodiment, when assembled, the outer surfaces of the stack 100 contact the inner surfaces of the external packaging box 40, and therefore, the stack 100 is substantially fixed in place with respect to the external packaging box 40. Moreover, even if a foreign object strikes the external packaging box 40, the photosensitive printing plates which form the stack 100 are protected from damage or deformation.

In addition, as with the previous embodiment, folding is only required along the bend lines 24 and 26 when the external packaging box 40 is assembled. Thus, the packaging box 40 can be readily assembled. It is not necessary to use a device for folding, and therefore, cost is reduced. The assembled external packaging box 40 is as a whole formed in such a manner that the attachment flaps 20 only overlap with the top surface member 14, and the length of each side panel 48 and its respective attachment flaps 20 extend from the bottom plate 16 (L3+L2) is shorter as compared with the conventional packaging boxes 11 and 140. Accordingly, the stack 100 is externally packaged by a reduced amount of material, thereby resulting in lower manufacturing cost for the external packaging box 40.

Figure 7:
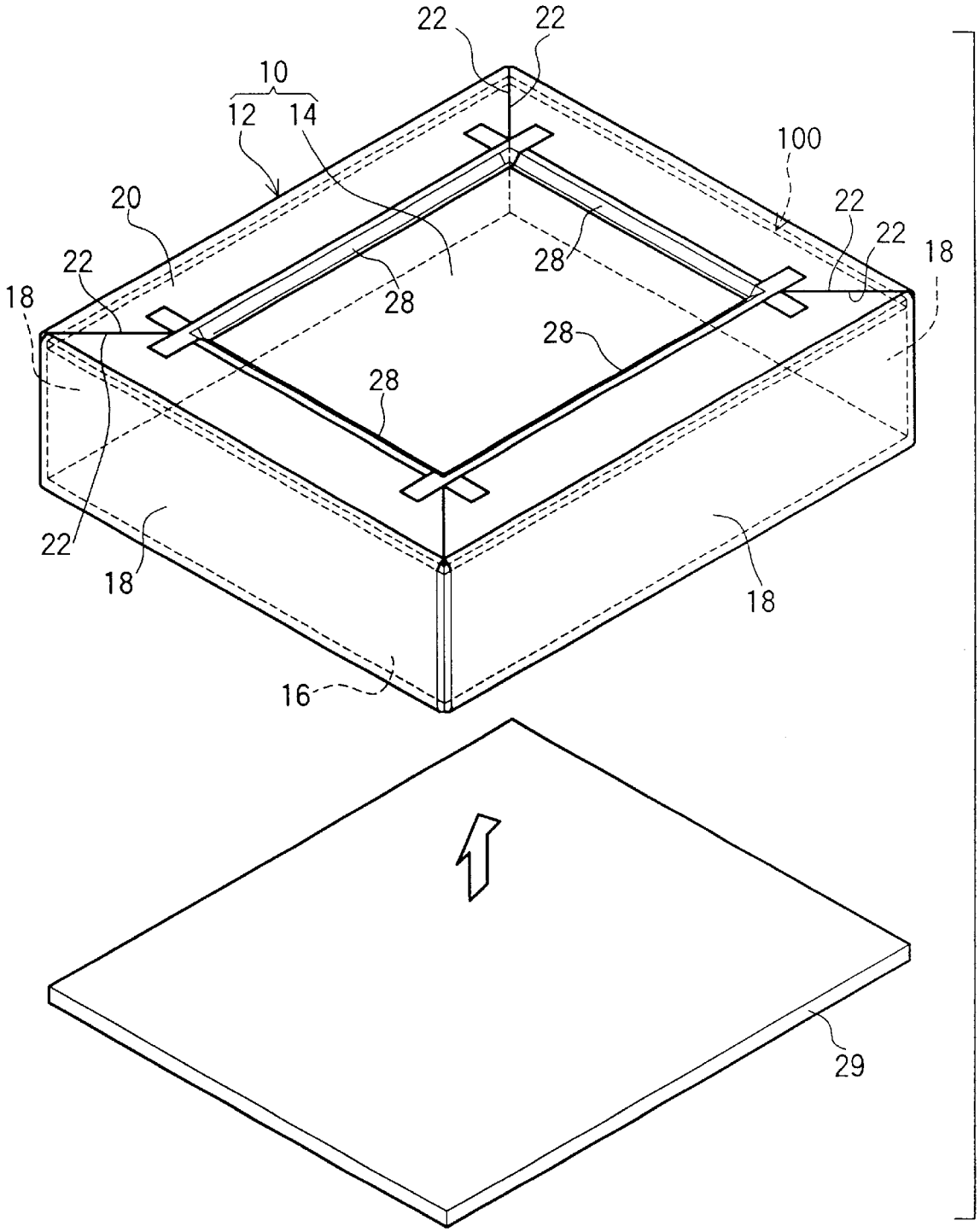
FIGS. 7 and 8 illustrate perspective views of the box of FIG. 1, showing alternate methods for fixing flaps of the box in place over the goods.
Figure 8:
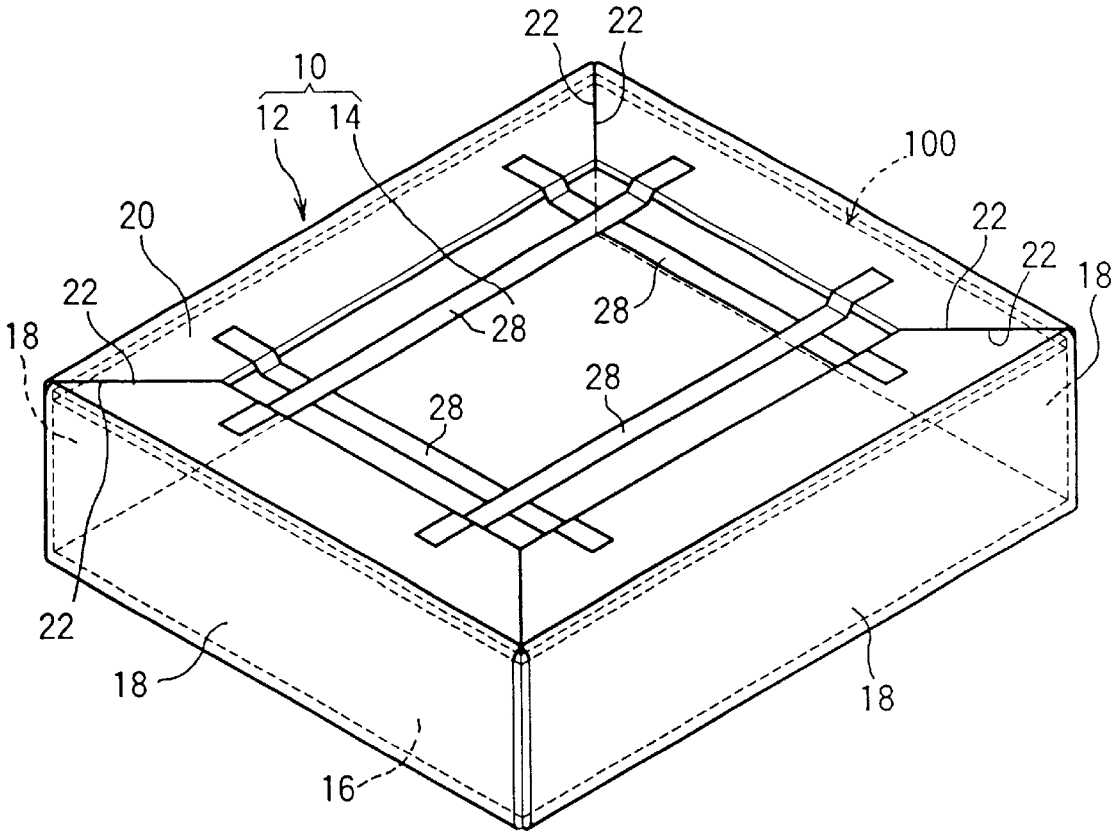

The areas where adhesive tape 28 is applied to the top plate member 14 (44) and the side panels 18 (42) to fix these items together is not necessarily limited to the previously described areas. For example, strips of adhesive tape 28 may be applied to cross each other substantially centrally or near the ends of the strips of the tape being applied to attachment flaps 20 or side panels 18 (42). In other words, when the top surface member 14 (44) is viewed from above, adhesive tape 28 is applied in the shape of a cross, a number sign "#", or a grid as shown in FIGS. 7 and 8. In this case, the top surface member 14 (44) is fixed by the adhesive tape 28 in at least two places on each attachment flap 20 (that is, the strips of adhesive tape 28 are applied in the shape of a number sign "#" or a grid). Thus, an unstable state of the top surface member 14 (44) with respect to the attachment flaps 20 or the side panels 18 (42) is prevented, which is preferable from the viewpoint of adherence strength. When adhesive tape 28 is applied in the shape of a number sign "#", for example, as shown in FIG. 7, the adhesive tape 28 may be applied along the interface between the attachment flaps 20 and the top surface member 14. Alternatively, as shown in FIG. 8, the adhesive tape 28 need not be applied along the interface between the attachment flaps 20 and the top surface member 14, but approximately parallel to the interface.

In the above-described external packaging boxes 10 and 40, the attachment flaps 20 may not be necessarily required. Namely, the edges of the top surface member 14 (44) and the ends of the side panels 18 (42) can be fixed together instead, by using the adhesive tape 28, if the attachment flaps 20 are not provided. When the attachment flaps 20 are not provided, the amount of material used for forming the external packaging box further decreases, thereby reducing manufacturing cost.

In the foregoing, the strength of the external packaging box 10 (40) is increased by orienting the corrugations in the sheet of corrugated fiberboard forming the bottom surface member 12 (42) substantially perpendicular or transverse to the direction of the corrugations in the sheet of corrugated fiberboard of the top plate member 14 (44) when the external packaging box 10 (44) is assembled. However, the respective directions of the corrugations in the sheets of corrugated fiberboard forming the bottom surface member and the top surface member are not limited to the same. Namely, so long as a predetermined strength can be maintained with the stack 100 being externally packaged by the external packaging box 10 (40), the respective directions of the corrugations in the sheets of corrugated fiberboard may be made parallel to each other or may cross each other than perpendicular angles.

Moreover, the relationship between the direction along which the stack 100 is located and the direction of the corrugations of the sheet of corrugated fiberboard forming the bottom surface member 12 (42) or the top surface member 14 (44) is not particularly limited. The direction of the corrugations of the corrugated fiberboard can be appropriately determined based on, for example, the strength demanded for the bottom plate member 12 (42) when using a corrugating machine for making corrugated fiberboard (that is, the sheet of corrugated fiberboard which forms the bottom surface member 12 (42)). In other words, as illustrated in each of the above-described embodiments, the strength of the bottom surface member 12 (42) can be increased by orienting the direction of the corrugations in the sheet of corrugated fiberboard substantially parallel to longer sides of the bottom of the stack 100 (see FIGS. 1 and 4). On the other hand, when the direction of the corrugations of the sheet of the corrugated fiberboard is made substantially parallel to the shorter sides of the bottom of the stack 100, the length of the corrugations of the sheet of corrugated fiberboard in a direction perpendicular to the flow direction in the corrugating machine (i.e., the transverse dimension of the sheet of corrugated fiberboard in the manufacturing process) is shorter. As a result, the bottom surface member 12 (42) can be manufactured by a small-size corrugating machine.

It is not necessary that the bottom surface member 12 (42) and the top surface member 14 (44) be formed by the above-described corrugated fiberboard. Any paper sufficient to protect the stack 100 from an external impact may be used, for example, cardboard, kraft paper, or a paper-made honeycomb structure material may be used. When a highly rigid material such as paper-made hard board is used for the outer layers of the bottom surface member 12 (42) and the top surface member 14 (44), from the viewpoint of protecting the stack 100, the stack 100 can be protected more effectively so as to prevent deformation from forces of even greater impacts. Similarly, by using an elastic material such as foamed resin for the inner layers of the bottom surface member 12 (42) and the top surface member 14 (42) (wherein the inner layers contact an intermediate wrapping material which wraps the stack 100), greater impact energy can be absorbed by elastic deformation of the elastic material and the stack 100 is protected more effectively.

Further, if cardboard or paper-made honeycomb structure material is used, a previously used external packaging box 10 (40) can be easily recycled or disposed of, and further, the external packaging box 10 (40) can be manufactured at lower cost. When cardboard is used, the strength of the box 10 can be further increased by orienting the direction of corrugations in the bottom and top surface members substantially perpendicular or orthogonal to the longer sides of the bottom of the stack 100.

In order to increase the strength of the base panel 16 to thereby improve an entire strength of the external packaging box 10 (40), a reinforcing plate formed substantially in the same shape and size as the top surface member 14 (44) may be attached to the base panel 16. Namely, when such a reinforcing plate is attached to the base panel 16, the bottom panel 16 and the reinforcing plate are integrated with each other to thereby improve the strength of the base panel 16, and further, the entire strength of the external packaging box 10 (40) also increases. Particularly, even when the weight of the stack 100 (goods to be packaged) is high or an area of the bottom of the stack 100 is large (in this case, since the area of the base panel 16 also becomes larger, the base panel 16 itself is subjected to greater risk of damage), the strength of the base panel 16 attached to and integrated with the reinforcing plate increases, and therefore, the risk of damage to the base panel 16 is reduced, thereby improving the strength of the packaging box 10 (40).

A method for attaching the reinforcing plate to the bottom plate 16 is not particularly limited. For example, adhesives such as normal paste, bond, and hot melt adhesive may be used, or a so-called double-sided adhesive tape may also be used. In any of these methods, the reinforcing plate is attached to the base panel 16 and there is little possibility of the reinforcing plate being inadvertently displaced or separated from the base panel 16.

Concrete examples of materials used for the reinforcing plate are not particularly limited. For example, when the bottom surface member 12 (42) or the top surface member 14 (44) are formed using corrugated fiberboard, the reinforcing plate can similarly be formed using corrugated fiberboard. In addition, cardboard, kraft paper, paper-made honeycomb structure material, and the like can also be used. When any of these paper materials is used as the reinforcing plate, the direction of the corrugations of the reinforcing plate is not particularly limited. However, by orienting the direction of the corrugations of the sheet of any one of the top surface member 14 (44), the base panel 16, and the reinforcing plate substantially transverse or orthogonal to the corrugations of the other items, the entire strength of the external packaging box 10 (40) can be further increased. Moreover, the strength of the base panel 16 integrated with the reinforcing member is further improved in such a manner that the direction of the corrugations in the base plate 16 is oriented substantially transverse that of the reinforcing plate. This is particularly preferable from the viewpoint of increasing the overall strength of the external packaging box 10 (40).

Although the reinforcing plate may be attached to the upper surface of the base panel 16 (the interior of the external packaging box 10 (40)), it may also be attached to the lower surface of the base panel 16 (the exterior of the external packaging box 10 (40)). When the reinforcing plate is attached to the upper surface of the base panel 16, it is surrounded by the side panels 18 and the load of the stack 100 (goods to be packaged) is supported by the entire reinforcing plate, which is more preferable from the viewpoint of the strength of the external packaging box. Further, the periphery of the reinforcing plate is not visible from the exterior of the external packaging box 10 (40), which is also preferable from the viewpoint of appearance. On the other hand, when the reinforcing plate is attached to the lower surface of the base panel 16, it can be attached even after packaging of the stack 100 in the external packaging box 10 (40). FIG. 7 illustrates a reinforcing plate 29 for attachment to the bottom of the packaging box 10 (40).

When corrugated fiberboard is used for each of the bottom surface member 12 (42) and the top surface member 14 (44), it is preferable from the viewpoint of maintaining a uniform strength and the like that the following conditions are satisfied.

First, the most preferable type of flute of the corrugated fiberboard is a BA flute or AB flute, followed by an A flute, a C flute, and a B flute B in that order. Further, the most preferable type of liner for the front and rear liners of the corrugated fiberboard is AA liner, followed by A liner, B liner, and C liner. The basic weight of the front and rear liners is in the range of 160 to 340 g/m$^2$. The most preferable type of corrugation for the corrugated fiberboard is a reinforced ruffled inner layer, followed by an A ruffled inner layer, a B ruffled inner layer, and a C ruffled inner layer, and the basic weight of the ruffled inner layer is in the range of 115 to 280 g/m$^2$.

As an example, the bottom surface member 12 (42) and the top surface member 14 (44) may be formed form corrugated fiberboard of a flute A, in which kraft paper having a basic weight of 280 g/m$^2$ is used for the front and rear liners and semi-chemical pulp having a basic weight of 125 g/m$^2$ is used as the ruffled inner layer.

When a honeycomb structure material is used in place of the corrugated fiberboard, the same front liner, rear liner, and ruffled inner layer as those of the above-described corrugated fiberboard are preferably used.

Further, when cardboard is used in place of the corrugated fiberboard, the basic weight thereof is preferably in the range of 600 to 2,000 g/m$^2$.

The goods to be packaged by the external packaging box of the present invention is not limited to the above-described stack 100 comprised of photosensitive printing plates. For example, the stack 100 may be composed of a wide range of general printing plates, such as heat sensitive printing plates, which can be packaged. An example of photosensitive printing plate is described below.

One example of photosensitive printing plate which can form the stack 100 is an aluminum plate of 0.3 mm×1,310 mm×1,120 mm with a photosensitive layer being applied thereto (in the case of a heat sensitive printing plate, a heat sensitive layer is applied onto the aluminum plate).

An example of interposing paper is interposing paper made form bleached kraft pulp having a basic weight of 30 to 45 g/m$^2$, a density of 0.7 to 0.85 g/cm$^3$, a moisture content of 4 to 6%, a Beck smoothness of 50 to 200 seconds, and a pH of 4 to 6. The obtained interposing paper is closely adhered to the above-described coating layer (photosensitive or heat sensitive layer) applied onto the aluminum plate and 10 to 100 sheets of printing plates and interposing paper are alternately superposed. Further, protective cardboard made from waste paper and having a basic weight of 400 to 1,500 g/m$^2$, a density of 0.7 to 0.85 g/cm$^3$, a moisture content of 4 to 8%, a Beck smoothness of 3 to 20 seconds, and a pH of 4 to 6 is disposed at each of upper and lower sides of the superposed plates and the stack 100 is thereby formed. Moreover, a kraft adhesive tape may be used to hold the facing sides of the protective cardboard and the printing plates at two places of each side so that the protective cardboard and the printing plates are fixed relative to each other. The protective cardboard is not particularly limited to the above-described type, but it is particularly preferable to use cardboard with a moisture proof layer applied onto at least one of front and rear sides thereof so as to prevent the quality of a coating film of a planographic printing plate (that is, a photosensitive layer of a photosensitive printing plate, or a heat sensitive layer of a heat sensitive printing plate) from being adversely affected by moisture content in the protective cardboard itself.

So long as the moisture proof layer is provided only on the surface of the protective cardboard facing the coating film of the planographic printing plate, it is possible to prevent the coating film from being adversely affected by moisture content in the protective cardboard itself. However, when planographic printing plates superposed with coating films being applied onto lower surfaces thereof (planographic printing plates each having coating films applied onto both surfaces thereof, or planographic printing plates superposed in such a manner that a surface of each plate with a coating film applied thereto is disposed to face downward) are provided, the protective cardboard is used in a reversed state so that the moisture proof layer faces the coating film. On the other hand, when protective cardboard with the moisture proof layers applied on both surfaces is used, it is not necessary that the protective cardboard is faced in a particular direction. Accordingly, an operation of forming the stack 100 becomes facilitated. Whichever type of protective cardboard is used, an effect obtained by providing the moisture proof layer (that is, removal of an adverse effect exerted on the coating film by moisture content in the protective cardboard itself) is exhibited irrespective of the presence of the interposing paper between the coating film of the planographic printing plate and the moisture proof layer of the protective cardboard.

Further, protective cardboard with the moisture proof layer being applied onto only one surface thereof is apt to warp in response to environmental changes, such as humidity change. However, protective cardboard with the moisture proof layers applied to both surfaces thereof is less apt to warp in response to environmental changes. Accordingly, protective cardboard with the moisture proof layers applied to both surfaces thereof is more preferably used.

The type of material for the moisture proof layer is not particularly limited. For example, low density polyethylene (LDPE) or high density polyethylene (HDPE), and other various resin films each having a moisture proof effect can be used. Further, a moisture proof layer may be formed by applying a coating of a liquid-like moisture proof agent. The thickness of the moisture proof layer is not also particularly limited, but as the thickness of the moisture proof layer increases, the moisture proof effect becomes higher. For example, when low density polyethylene is used, a sufficient moisture proof effect can be obtained by a thickness in the range from 10 to 60 $\mu$m.

Figure 9A:
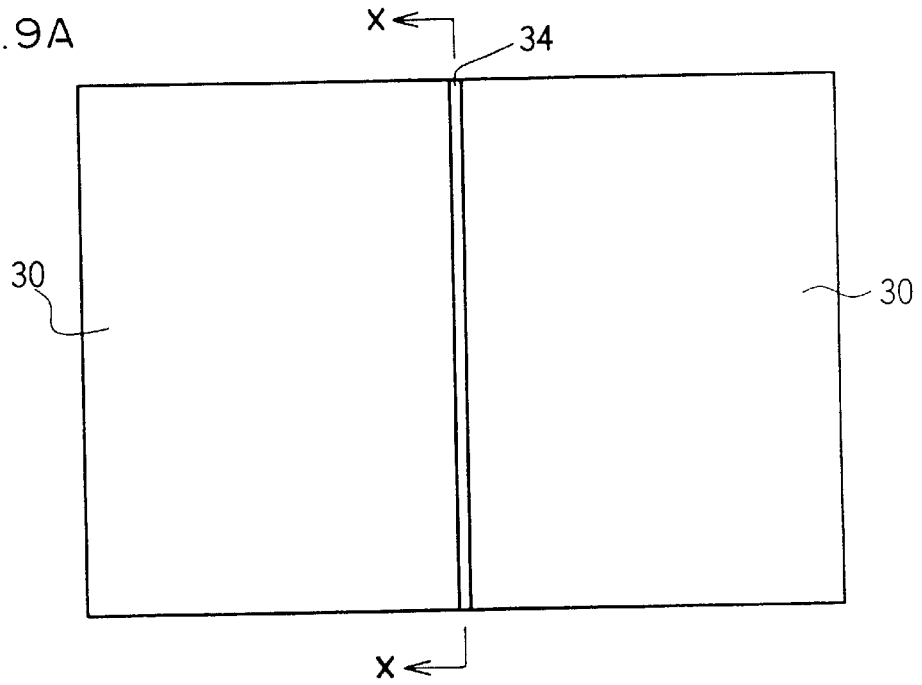
FIG. 9A illustrates a plan view of two sheets of protective cardboard fastened together for use in accordance with the present invention, wherein each sheet of cardboard is approximately one half the size of a planographic printing plate.

It is not necessary that a sheet of protective cardboard be of substantially the same size as a planographic printing plate. Namely, plural sheets of protective cardboard, each of which is smaller than the planographic printing plate are fastened together so as to be made substantially in the same size as the planographic printing plate. For example, as shown in FIG. 9A, two sheets of cardboard 30 of which sizes are each one half of the planographic printing plate are fastened together to form one sheet of protective cardboard having the desired dimensions. Further, as shown in FIG. 9B, four sheets of cardboard 32 of which sizes are each a quarter of the planographic printing paper (which are obtained by dividing the planographic printing-size paper along vertical and horizontal lines so as to form four parts of the same size) are fastened together to form one protective cardboard having the desired dimensions.

A method for fastening plural sheets of cardboard 30 or 32 together is not particularly limited. For example, as shown in FIGS. 9A, 9B, and 9C, these sheets of cardboard can be fastened together using adhesive tape 34. In this case, for example, the adhesive tape 34 is continuously applied to a portion where respective sides of the sheets of cardboard 30 (32) contact each other so that the portion and the adhesive tape 34 are made parallel to each other, and the adhesive tape 34 is cut down in such a manner that vicinities of both ends of the adhesive tape 34 are each folded back to a rear surface of the cardboard 30 (32) (see FIG. 9C). As a result, these sheets of cardboard can be reliably fastened together with a small amount of tape.

The kind of adhesive tape 34 is not particularly limited so long as the quality of the planographic printing plate is not adversely affected thereby. For example, a kraft adhesive tape can be used.

Figure 9B:
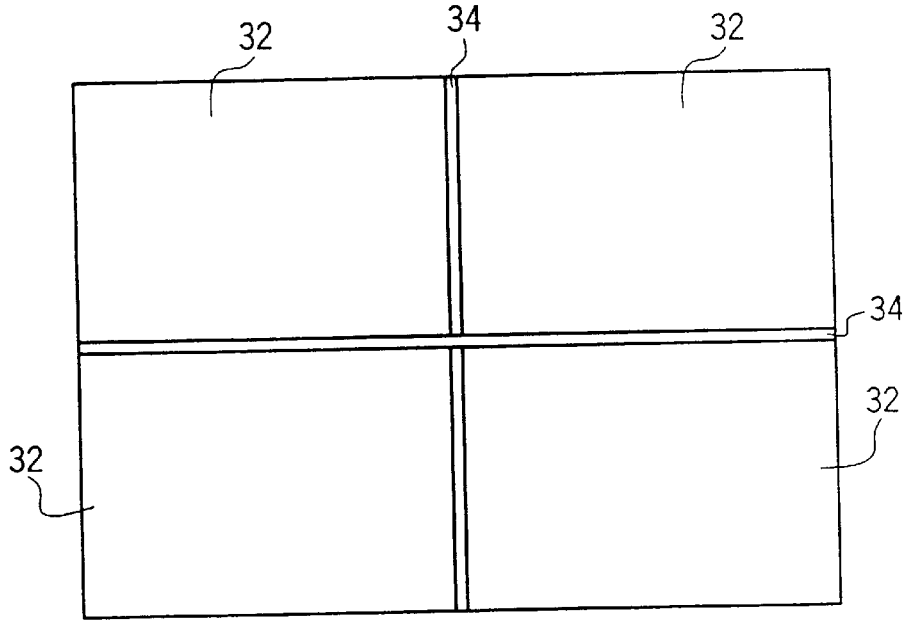
FIG. 9B illustrates a plan view showing four sheets of protective cardboard fastened together for use in accordance with the present invention, wherein each cardboard sheet is approximately a quarter of the size of a planographic printing plate.
Figure 9C:
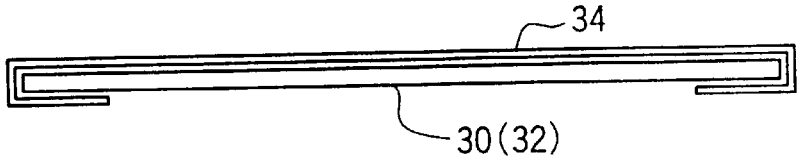
FIG. 9C illustrates a cross-sectional view through the structure in FIG. 9A, taken along section line X—X in FIG. 9A.

Further, one sheet of protective cardboard which is of the same size of the planographic printing paper, the protective cardboard which is formed by fastening together sheets of cardboard 30 or 32 shown in FIG. 9A or 9B, and a protective cardboard having a moisture proof layer and an ordinary protective cardboard having no moisture proof layer can be used in arbitrary combination when necessary in consideration of dimensions of each protective cardboard or quality suitability.

An example of light proof and moisture proof paper which can be used as an intermediate wrapping (packaging) material is an aluminum kraft paper with aluminum foil of 6 $\mu$m being adhered to kraft paper having a basic weight of 85 g/m$^2$ by low density polyethylene of 13 $\mu$m. The stack 100 is intermediately wrapped (packaged) using the above-mentioned aluminum kraft paper and is further fixed using an adhesive tape. The light proof and moisture proof paper is not limited to the above-described example. For example, paper provided with low density polyethylene of 10 to 70 $\mu$m being adhered to the aluminum foil having the above-described structure may also be used.

When the stack 100 has the above-described shape, the length L of extension of the attachment plate 20 is preferably 200 mm or thereabouts, but is not limited to the same. Further, an example of the adhesive tape 28 is preferably a kraft adhesive tape having a transverse dimension of 75 mm or thereabouts, but is not limited to the same.

The stack 100 is also not limited to that described above. For example, the stack may have no interposing paper, and alternatively, the stack may be comprised of 1,500 superposed printing plates at the maximum with the above-described protective cardboard provided every 20 to 100 sheets, or the stack may also be comprised of 1,500 printing plates at the maximum with the protective cardboard provided only at upper and lower sides of the stack.

What is claimed is:

1. A packaging box in combination with a stack of sheets, the stack including a top surface, a bottom surface, and a number of side surfaces, the packaging box comprising:

a bottom surface member having a base panel formed substantially in the same shape as the bottom surface of the stack of sheets;

a plurality of side panels, each respectively having an inner contact surface and a pair of end surfaces, such that a pair of edge portions are respectively formed at an intersection of the inner contact surface and the pair of end surfaces, the side panels correspond in number to the number of side surfaces of the stack of sheets, and each side panel extends integrally from the base panel and is substantially the same shape as a corresponding one of the side surfaces of the stack of sheets; and a top surface member having dimensions which are substantially equal to dimensions of the top surface of the stack of sheets, wherein when the side panels are brought into contact with the corresponding side of the stack of sheets, the only contact panels between adjacent side panels is between respective edge portions of adjacent side panels.

2. A packaging box in combination with a stack of sheets according to claim 1, further comprising a plurality of attachment flaps integrally extending from each side panel, wherein when the packaging box is assembled, each side panel is folded to a position which is substantially parallel to a corresponding one of the side surfaces of the stack of sheets, and the attachment flaps are folded over the top surface member to extend substantially parallel to the top surface member with the attachment flaps not overlapping one another.

3. A packaging box in combination with a stack of sheets according to claim 2, wherein when the attachment flaps are folded over the top surface member, the attachment flaps define an opening in which the top surface member is disposed.

4. A packaging box in combination with a stack of sheets according to claim 3, wherein the attachment flaps respectively have a pair of end surfaces, and wherein respective end surfaces of adjacent attachment flaps contact each other when each attachment flap is folded so as to be parallel with the top surface of the stack of sheets, such that the adjacent attachment flaps do not overlap each other.

5. A packaging box in combination with a stack of sheets according to claim 2, wherein said bottom surface member and said top surface member each have at least one side which includes an impact absorbent material disposed thereover.

6. A packaging box in combination with a stack of sheets according to claim 2, wherein each side panel extends a distance from the bottom surface member which is substantially equal to a height dimension of the stack of sheets, and length and width dimensions of said top surface member are each set so as to be substantially equal to a length and width dimensions, respectively, of the stack of sheets, plus twice the thickness dimension of one of the side panels, wherein all of the side panels have a thickness that is substantially the same.

7. A packaging box in combination with a stack of sheets according to claim 6, wherein a reinforcing plate formed substantially in the same shape as said top surface member is attached to the bottom surface member.

8. A packaging box in combination with a stack of sheets according to claim 7, wherein each side panel extends from the bottom surface member a distance substantially equal to a height dimension of the stack of sheets, plus a thickness dimension of said reinforcing plate.

9. A packaging box according to claim 8, wherein the bottom surface member and the top surface member each have greater strength in a first direction, and wherein when the packaging box is assembled, the first direction of the bottom surface member is substantially oriented in a direction transverse to the first direction of the top surface member.

10. A packaging box in combination with a stock of sheets according to claim 2, wherein the attachment flaps have beveled corners.

11. A packaging box in combination with a stack of sheets according to claim 1, wherein the stack is wrapped by a wrapping material and formed substantially to have a shape of a right rectangular parallelepiped.

12. A packaging box in combination with a stack of sheets according to claim 1, further comprising a fixing member for maintaining the shape of the packaging box, the fixing member being provided only on the top surface member.

13. A packaging box in combination with a stack of sheets according to claim 12, wherein the fixing member is provided only along a periphery of the top surface member.

14. A packaging box in combination with a stack of sheets, the stack including a top surface, a bottom surface, and a number of side surfaces, the packaging box comprising:

a bottom surface member having a base panel formed substantially in the same shape as the bottom surface of the stack sheets;

a plurality of side panels which correspond in number to the number of side surfaces of the stack of sheets, each side panel extends integrally from the base panel and is substantially the same shape as a corresponding one of the side surfaces of the stack of sheets;

a top surface member having dimensions which are substantially equal to dimensions of the top surface of the stack of sheets; and an attachment flap which integrally extends from each side panel, the attachments flaps respectively have a pair of end surfaces;

wherein respective end surfaces of adjacent attachment flaps contact each other when each attachment flap is folded so as to be parallel with the top surface of the stack of sheets, such that the adjacent attachment flaps do not overlap each other.

15. A packaging box in combination with a stack of sheets, the stack including a top surface, a bottom surface, and a number of side surfaces, the packaging box comprising:

a bottom surface member having a base panel formed substantially in the same shape as the bottom surface of the stack of sheets;

a plurality of side panels which correspond in number to the number of side surfaces of the stack of sheets, each side panel extends integrally from the base panel and is substantially the same shape as a corresponding one of the side surfaces of the stack of sheets;

a top surface member having dimensions which are substantially equal to dimensions of the top surface of the stack of sheets;

an attachment flap integrally extending from each side panel; and a fixing member for maintaining the shape of the packaging box, the fixing member being provided only on the top surface member.

16. A packaging box in combination with a stack of sheets according to claim 15, wherein the fixing member is provided only along a periphery of the top surface member.

* * * * *